US006106662A

United States Patent [19]

Bibby, Jr. et al.

[11] Patent Number: 6,106,662

[45] Date of Patent: Aug. 22, 2000

[54] METHOD AND APPARATUS FOR ENDPOINT DETECTION FOR CHEMICAL MECHANICAL POLISHING

[75] Inventors: Thomas Frederick Allen Bibby, Jr., Gilbert, Ariz.; John A. Adams, Escondido, Calif.; Robert A. Eaton, Scottsdale, Ariz.; Christopher E. Barns, Portland, Oreg.; Charles Hannes, Phoenix, Ariz.

[73] Assignee: SpeedFam-IPEC Corporation, Chandler, Ariz.

[21] Appl. No.: 09/093,467

[22] Filed: Jun. 8, 1998

[51] Int. Cl.[7] ..... B24B 5/00

[52] U.S. Cl. ..... 156/345; 216/89; 451/287; 438/692

[58] Field of Search ..... 156/345; 216/88, 216/89, 90; 438/692; 451/526, 285–288

[56] References Cited

U.S. PATENT DOCUMENTS

| | | |
|---|---|---|
| 5,101,602 | 4/1992 | Hashimoto . |
| 5,131,752 | 7/1992 | Yu et al. . |
| 5,157,877 | 10/1992 | Hashimoto . |
| 5,552,327 | 9/1996 | Bachmann et al. . |
| 5,554,064 | 9/1996 | Breivogel et al. . |
| 5,558,563 | 9/1996 | Cote et al. . |
| 5,564,965 | 10/1996 | Tanaka et al. . |
| 5,650,039 | 7/1997 | Talieh . |
| 5,664,989 | 9/1997 | Nakata et al. . |
| 5,725,420 | 3/1998 | Torii . |
| 5,735,731 | 4/1998 | Lee . |
| 5,762,539 | 6/1998 | Nakashiba et al. . |
| 5,769,691 | 6/1998 | Fruitman . |
| 5,788,560 | 8/1998 | Hashimoto et al. . |
| 5,795,215 | 8/1998 | Guthrie et al. . |
| 5,795,218 | 8/1998 | Doan et al. . |
| 5,807,161 | 9/1998 | Manor et al. . |
| 5,872,633 | 2/1999 | Holzapfel et al. ..... 356/381 |

FOREIGN PATENT DOCUMENTS 11048133 2/1999 Japan .

OTHER PUBLICATIONS

Shi, F.G. and Zhao, B., "Modeling of chemical–mechanical polishing with soft pads," *Appl. Phys.* (1998), pp. 249–252.

Fiber Optic Rotary Joint Model 214, Focal Technologies, Inc. (1998).

Fiber Optic Rotary Joint Model 215 Ultra–compact, 2 channels, Focal Technologies Inc. (1998).

*Primary Examiner*—Richard Bueker
*Assistant Examiner*—Alva C Powell
*Attorney, Agent, or Firm*—Merchant & Gould P.C.

[57] ABSTRACT

An apparatus to generate an endpoint signal to control the polishing of thin films on a semiconductor wafer surface includes a through-hole in a polish pad, a light source, a fiber optic cable, a light sensor, and a computer. A pad assembly includes the polish pad, a pad backer, and a pad backing plate. The pad backer includes a pinhole and a canal that holds the fiber optic cable. The pad backer holds the polish pad so that the through-hole is coincident with the pinhole opening. A wafer chuck holds a semiconductor wafer so that the surface to be polished is against the polish pad. The light source provides light within a predetermined bandwidth. The fiber optic cable propagates the light through the through-hole opening to illuminate the surface as the pad assembly orbits and the chuck rotates. The light sensor receives reflected light from the surface through the fiber optic cable and generates reflected spectral data. The computer receives the reflected spectral data and calculates an endpoint signal. For metal film polishing, the endpoint signal is based upon the intensities of two individual wavelength bands. For dielectric film polishing, the endpoint signal is based upon fitting of the reflected spectrum to an optical reflectance model to determine remaining film thickness. The computer compares the endpoint signal to predetermined criteria and stops the polishing process when the endpoint signal meets the predetermined criteria.

35 Claims, 7 Drawing Sheets

METHOD AND APPARATUS FOR ENDPOINT DETECTION FOR CHEMICAL MECHANICAL POLISHING

FIELD OF THE INVENTION

The present invention relates to chemical mechanical polishing (CMP), and more particularly, to optical endpoint detection during a CMP process.

BACKGROUND INFORMATION

Chemical mechanical polishing (CMP) has emerged as a crucial semiconductor technology, particularly for devices with critical dimensions smaller than 0.5 micron. One important aspect of CMP is endpoint detection (EPD), i.e., determining during the polishing process when to terminate the polishing.

Many users prefer EPD systems that are "in situ EPD systems", which provide EPD during the polishing process. Numerous in situ EPD methods have been proposed, but few have been successfully demonstrated in a manufacturing environment and even fewer have proved sufficiently robust for routine production use.

One group of prior art in situ EPD techniques involves the electrical measurement of changes in the capacitance, the impedance, or the conductivity of the wafer and calculating the endpoint based on an analysis of this data. To date, these particular electrically based approaches to EPD are not commercially available.

One other electrical approach that has proved production worthy is to sense changes in the friction between the wafer being polished and the polish pad. Such measurements are done by sensing changes in the motor current. These systems use a global approach, i.e., the measured signal assesses the entire wafer surface. Thus, these systems do not obtain specific data about localized regions. Further, this method works best for EPD for metal CMP because of the dissimilar coefficient of friction between the polish pad and the tungsten-titanium nitride-titanium film stack versus the polish pad and the dielectric underneath the metal. However, with advanced interconnection conductors, such as copper (Cu), the associated barrier metals, e.g., tantalum or tantalum nitride, may have a coefficient of friction that is similar to the underlying dielectric. The motor current approach relies on detecting the copper-tantalum nitride transition, then adding an overpolish time. Intrinsic process variations in the thickness and composition of the remaining film stack layer mean that the final endpoint trigger time may be less precise than is desirable.

Another group of methods uses an acoustic approach. In a first acoustic approach, an acoustic transducer generates an acoustic signal that propagates through the surface layer(s) of the wafer being polished. Some reflection occurs at the interface between the layers, and a sensor positioned to detect the reflected signals can be used to determine the thickness of the topmost layer as it is polished. In a second acoustic approach, an acoustical sensor is used to detect the acoustical signals generated during CMP. Such signals have spectral and amplitude content that evolves during the course of the polish cycle. However, to date there has been no commercially available in situ endpoint detection system using acoustic methods to determine endpoint.

Finally, the present invention falls within the group of optical EPD systems. One approach for optical EPD systems is of the type disclosed in U.S. Pat. No. 5,433,651 to Lustig et al. in which a window in the platen of a rotating CMP tool is used to sense changes in a reflected optical signal. However, the window complicates the CMP process because it presents to the wafer an inhomogeneity in the polish pad. Such a region can also accumulate slurry and polish debris.

Another approach is of the type disclosed in European application EP 0 824 995 A1, which uses a transparent window in the actual polish pad itself. A similar approach for rotational polishers is of the type disclosed in European application EP 0 738 561 A1, in which a pad with an optical window is used for EPD. In both of these approaches, various means for implementing a transparent window in a pad are discussed, but making measurements without a window was not considered. The methods and apparatuses disclosed in these patents require sensors to indicate the presence of a wafer in the field of view. Furthermore, integration times for data acquisition are constrained to the amount of time the window in the pad is under the wafer.

In another type of approach, the carrier is positioned on the edge of the platen so as to expose a portion of the wafer. A fiber optic based apparatus is used to direct light at the surface of the wafer, and spectral reflectance methods are used to analyze the signal. The drawback of this approach is that the process must be interrupted in order to position the wafer in such a way as to allow the optical signal to be gathered. In so doing, with the wafer positioned over the edge of the platen, the wafer is subjected to edge effects associated with the edge of the polish pad going across the wafer while the remaining portion of the wafer is completely exposed. An example of this type of approach is described in PCT application WO 98/05066.

In another approach, the wafer is lifted off of the pad a small amount, and a light beam is directed between the wafer and the slurry-coated pad. The light beam is incident at a small angle so that multiple reflections occur. The irregular topography on the wafer causes scattering, but if sufficient polishing is done prior to raising the carrier, then the wafer surface will be essentially flat and there will be very little scattering due to the topography on the wafer. An example of this type of approach is disclosed in U.S. Pat. No. 5,413,941. The difficulty with this type of approach is that the normal process cycle must be interrupted to make the measurement.

Yet another approach entails monitoring absorption of particular wavelengths in the infrared spectrum of a beam incident upon the backside of a wafer being polished so that the beam passes through the wafer from the nonpolished side of the wafer. Changes in the absorption within narrow, well defined spectral windows correspond to changing thickness of specific types of films. This approach has the disadvantage that, as multiple metal layers are added to the wafer, the sensitivity of the signal decreases rapidly. One example of this type of approach is disclosed in U.S. Pat. No. 5,643,046.

Each of these above methods has drawbacks of one sort or another. What is needed is a new method for in situ EPD that provides continuous sampling and noise immunity, can work with multiple underlying metal layers, can measure dielectric layers, and provides ease of use for the manufacturing environment.

SUMMARY

An apparatus is provided for use with a tool for polishing thin films on a semiconductor wafer surface that detects an endpoint of a polishing process. In one embodiment, the apparatus includes a polish pad having a through-hole, a light source, a fiber optic cable assembly, a light sensor, and a computer. The light source provides light within a predetermined bandwidth. The fiber optic cable propagates the light through the through-hole to illuminate the wafer surface during the polishing process. The light sensor receives reflected light from the surface through the fiber optic cable and generates data corresponding to the spectrum of the reflected light. The computer receives the reflected spectral data and generates in endpoint signal as a function of the reflected spectral data. In a metal film polishing application, the endpoint signal is a function of the intensities of at least two individual wavelength bands selected from the predetermined bandwidth. In a dielectric film polishing application, the endpoint signal is based upon fitting of the reflected spectrum to an optical reflectance model to determine remaining film thickness. The computer compares the endpoint signal to predetermined criteria and stops the polishing process when the endpoint signal meets the predetermined criteria. Unlike prior art optical endpoint detection systems, an apparatus according to the present invention, together with the endpoint detection methodology, advantageously allows for accuracy and reliability in the presence of accumulated slurry and polishing debris. This robustness makes the apparatus suitable for in situ EPD in a production environment.

BRIEF DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION

The present invention relates to a method of EPD using optical means and also to a method of processing the optical data. CMP machines typically include a means of holding a wafer or substrate to be polished. Such holding means are sometimes referred to as a carrier, but the holding means of the present invention is referred to herein as a "wafer chuck". CMP machines also typically include a polishing pad and a means to support the pad. Such pad support means are sometimes referred to as a polishing table or platen, but the pad support means of the present invention is referred to herein as a "pad backer". Slurry is required for polishing and is delivered either directly to the surface of the pad or through holes and grooves in the pad directly to the surface of the wafer. The control system on the CMP machine causes the surface of the wafer to be pressed against the pad surface with a prescribed amount of force. The motion of the wafer is arbitrary, but is rotational about its center around an axis perpendicular to the plane of the wafer in a preferred embodiment.

Further, as will be described below, the motion of the polishing pad is preferably nonrotational to enable a short length of fiber optic cable to be inserted into the pad without breaking. Instead of being rotational, the motion of the pad is "orbital" in a preferred embodiment. In other words, each point on the pad undergoes circular motion about its individual axis, which is parallel to the wafer chuck's axis. In a preferred embodiment, the orbit diameter is 1.25 inches. Further, it is to be understood that other elements of the CMP tool not specifically shown or described may take various forms known to persons of ordinary skill in the art. For example, the present invention can be adapted for use in the CMP tool disclosed in U.S. Pat. No. 5,554,064, which is incorporated herein by reference.

Figure 1:
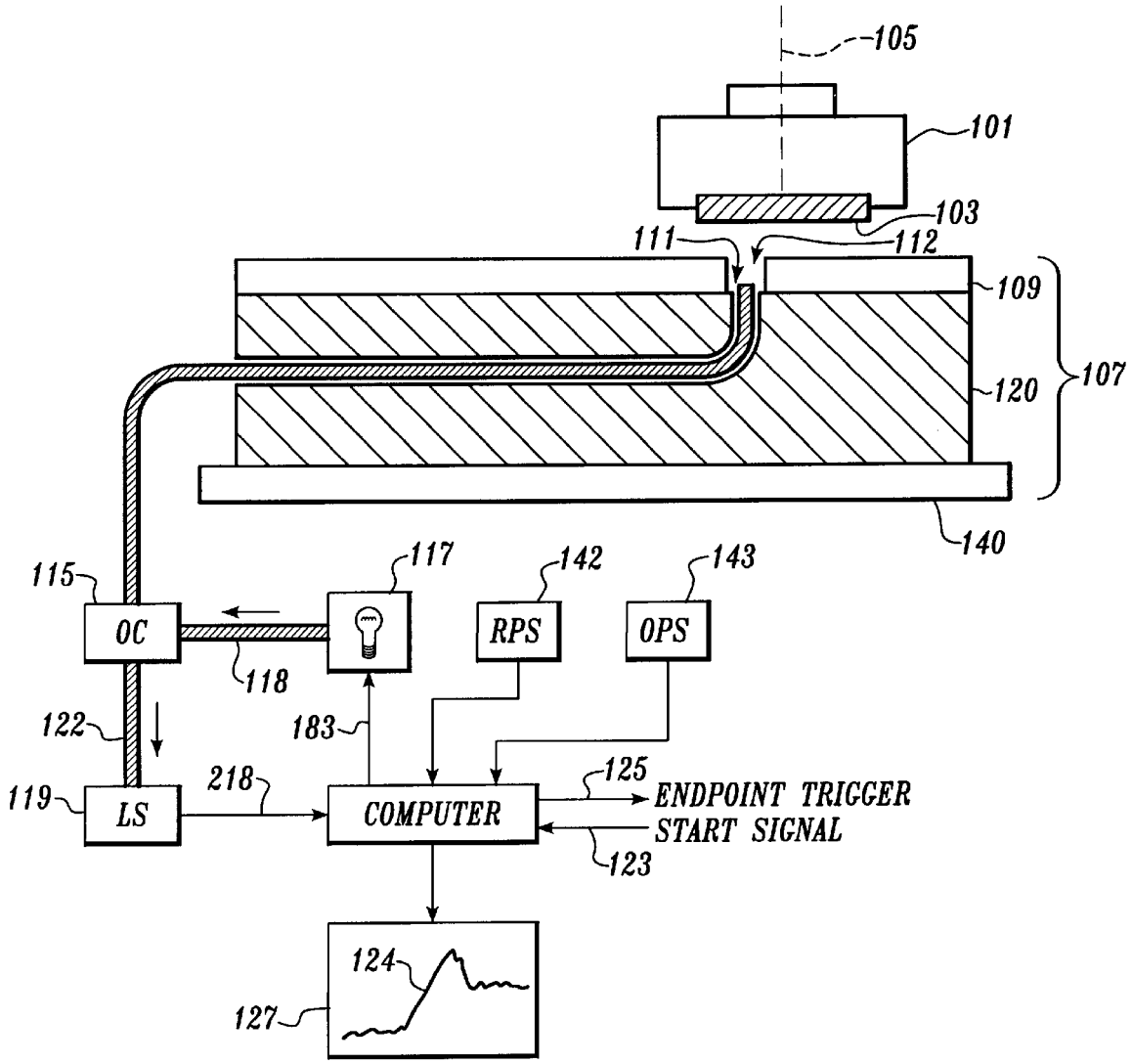
FIG. 1 is a schematic illustration of an apparatus formed in accordance with the present invention.

A schematic representation of the overall system of the present invention is shown in FIG. 1. As seen, a wafer chuck 101 holds a wafer 103 that is to be polished. The wafer chuck 101 preferably rotates about its vertical axis 105. A pad assembly 107 includes a polishing pad 109 mounted onto a pad backer 120. The pad backer 120 is in turn mounted onto a pad backing plate 140. In a preferred embodiment, the pad backer 120 is composed of urethane and the pad backing plate 140 is stainless steel. Other embodiments may use other suitable materials for the pad backer and pad backing. Further, the pad backing plate 140 is secured to a driver or motor means (not shown) that is operative to move the pad assembly 107 in the preferred orbital motion.

Polishing pad 109 includes a through-hole 112 that is coincident and communicates with a pinhole opening 111 in the pad backer 120. Further, a canal 104 is formed in the side of the pad backer 120 adjacent the backing plate. The canal 104 leads from the exterior side 110 of the pad backer 120 to the pinhole opening 111. In a preferred embodiment, a fiber optic cable assembly including a fiber optic cable 113 is inserted in the pad backer 120 of pad assembly 107, with one end of fiber optic cable 113 extending through the top surface of pad backer 120 and partially into through-hole 112. Fiber optic cable 113 can be embedded in pad backer 120 so as to form a watertight seal with the pad backer 120, but a watertight seal is not necessary to practice the invention. Further, in contrast to conventional systems as exemplified by U.S. Pat. No. 5,433,651 to Lustig et al. that use a platen with a window of quartz or urethane, the present invention does not include such a window. Rather, the pinhole opening 111 is merely an orifice in the pad backer in which fiber optic cable 113 may be placed. Thus, in the present invention, the fiber optic cable 113 is not sealed to the pad backer 120. Moreover, because of the use of a pinhole opening 111, the fiber optic cable 113 may even be placed within one of the existing holes in the pad backer and polishing pad used for the delivery of slurry without adversely affecting the CMP process. As an additional difference, the polishing pad 109 has a simple through-hole 112.

Fiber optic cable 113 leads to an optical coupler 115 that receives light from a light source 117 via a fiber optic cable 118. The optical coupler 115 also outputs a reflected light signal to a light sensor 119 via fiber optic cable 122. The reflected light signal is generated in accordance with the present invention, as described below.

A computer 121 provides a control signal 183 to light source 117 that directs the emission of light from the light source 117. The light source 117 is a broadband light source, preferably with a spectrum of light between 200 and 1000 nm in wavelength, and more preferably with a spectrum of light between 400 and 900 nm in wavelength. A tungsten bulb is suitable for use as the light source 117. Computer 121 also receives a start signal 123 that will activate the light source 117 and the EPD methodology. The computer also provides an endpoint trigger 125 when, through the analysis of the present invention, it is determined that the endpoint of the polishing has been reached.

Orbital position sensor 143 provides the orbital position of the pad assembly while the wafer chuck's rotary position sensor 142 provides the angular position of the wafer chuck to the computer 121, respectively. Computer 121 can synchronize the trigger of the data collection to the positional information from the sensors. The orbital sensor identifies which radius the data is coming from and the combination of the orbital sensor and the rotary sensor determine which point.

In operation, soon after the CMP process has begun, the start signal 123 is provided to the computer 121 to initiate the monitoring process. Computer 121 then directs light source 117 to transmit light from light source 117 via fiber optic cable 118 to optical coupler 115. This light in turn is routed through fiber optic cable 113 to be incident on the surface of the wafer 103 through pinhole opening 111 and the through-hole 112 in the polishing pad 109.

Reflected light from the surface of the wafer 103 is captured by the fiber optic cable 113 and routed back to the optical coupler 115. Although in the preferred embodiment the reflected light is relayed using the fiber optic cable 113, it will be appreciated that a separate dedicated fiber optic cable (not shown) may be used to collect the reflected light. The return fiber optic cable would then preferably share the canal 104 with the fiber optic cable 113 in a single fiber optic cable assembly.

The optical coupler 115 relays this reflected light signal through fiber optic cable 122 to light sensor 119. Light sensor 119 is operative to provide reflected spectral data 218, referred to herein as the reflected spectral date 218, of the reflected light to computer 121.

One advantage provided by the optical coupler 115 is that rapid replacement of the pad assembly 107 is possible while retaining the capability of endpoint detection on subsequent wafers. In other words, the fiber optic cable 113 may simply be detached from the optical coupler 115 and a new pad assembly 107 may be installed (complete with a new fiber optic cable 113). For example, this feature is advantageously utilized in replacing used polishing pads in the polisher. A spare pad backer assembly having a fresh polishing pad is used to replace the pad backer assembly in the polisher. The used polishing pad from the removed pad backer assembly is then replaced with a fresh polishing pad for subsequent use.

After a specified or predetermined integration time by the light sensor 119, the reflected spectral data 218 is read out of the detector array and transmitted to the computer 121, which analyzes the reflected spectral data 218. The integration time typically ranges from 5 to 150 ms, with the integration time being 15 ms in a preferred embodiment. One result of the analysis by computer 121 is an endpoint signal 124 that is displayed on monitor 127. Preferably, computer 121 automatically compares endpoint signal 124 to predetermined criteria and outputs an endpoint trigger 125 as a function of this comparison. Alternatively, an operator can monitor the endpoint signal 124 and select an endpoint based on the operator's interpretation of the endpoint signal 124. The endpoint trigger 125 causes the CMP machine to advance to the next process step.

Figure 2:
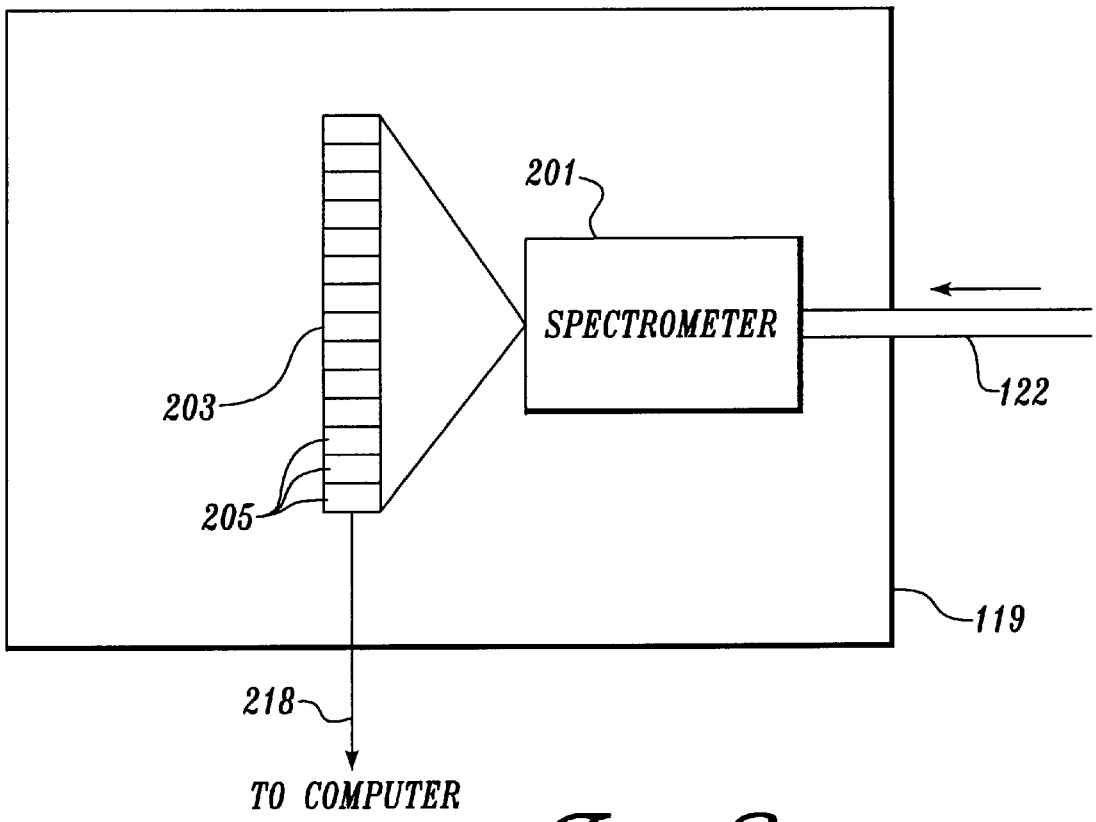
FIG. 2 is a schematic diagram of a light sensor for use in the apparatus of FIG. 1.
Figure 2A:
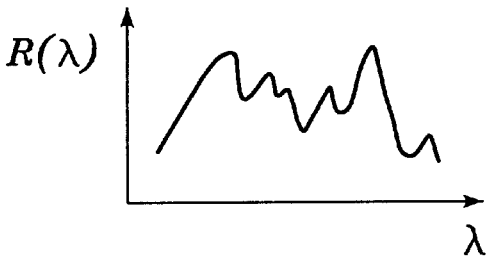
FIG. 2A is a diagram illustrating reflected spectral data.

Turning to FIG. 2, the light sensor 119 contains a spectrometer 201 that disperses the light according to wavelength onto a detector array 203 that includes a plurality of light-sensitive elements 205. The spectrometer 201 uses a grating to spectrally separate the reflected light. The reflected light incident upon the light-sensitive elements 205 generates a signal in each light-sensitive element (or "pixel") that is proportional to the intensity of light in the narrow wavelength region incident upon said pixel. The magnitude of the signal is also proportional to the integration time. Following the integration time, reflected spectral data 218 indicative of the spectral distribution of the reflected light is output to computer 121 as illustrated in FIG. 2A.

In light of this disclosure, it will be appreciated that, by varying the number of pixels 205, the resolution of the reflected spectral data 218 may be varied. For example, if the light source 117 has a total bandwidth of between 200 to 1000 nm, and if there are 980 pixels 205, then each pixel 205 provides a signal indicative of a wavelength band spanning 10 nm (9800 nm divided by 980 pixels). By increasing the number of pixels 205, the width of each wavelength band sensed by each pixel may be proportionally narrowed. In a preferred embodiment, detector array 203 contains 512 pixels 205.

Figure 3:
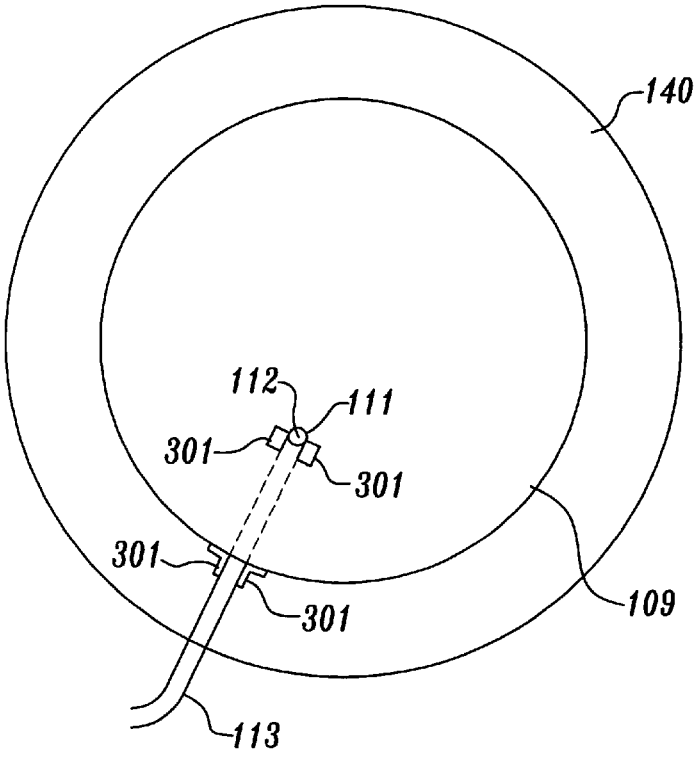
FIG. 3 is a top view of the pad assembly for use in the apparatus of FIG. 1.

FIG. 3 shows a top view of the pad assembly 107. The pad backing plate 140 has a pad backer 120 (not shown in FIG. 3) secured to its top surface. Atop the pad backer 120 is secured the polishing pad 109. Pinhole opening 111 and through-hole 112 are shown near a point in the middle of the polishing pad 109, though any point in the polishing pad 109 can be used. The fiber optic cable 113 extends through the body of the pad backer 120 and emerges in pinhole opening 111. Further, clamping mechanisms 301 are used to hold the fiber optic cable 113 in fixed relation to the pad assembly 107. Clamping mechanisms do not extend beyond the plane of interface between the pad backer 120 and the polishing pad 120.

Figure 4:
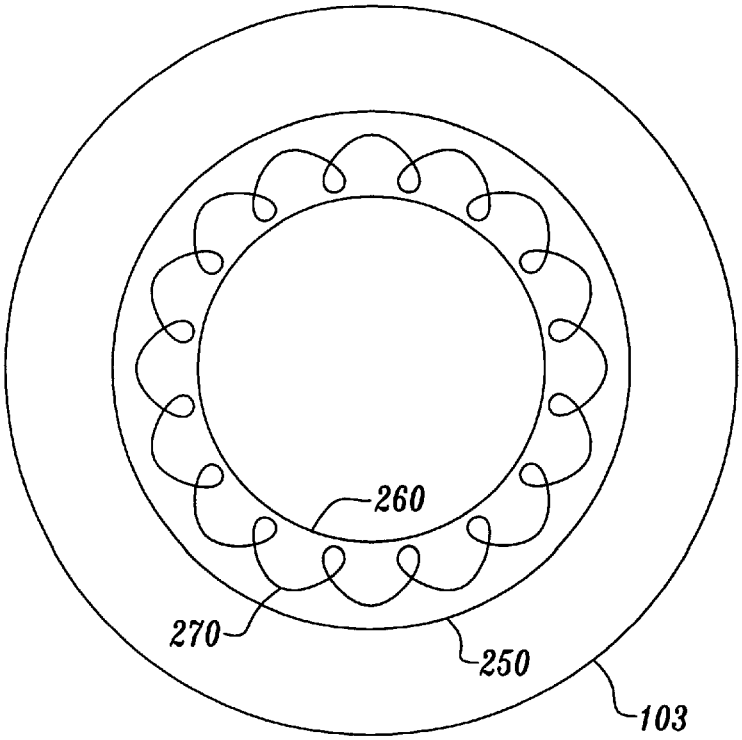
FIG. 4 illustrates an example trajectory for a given point on the pad showing the annular region that is traversed on the wafer when the wafer rotates and the pad orbits.

With a rotating wafer chuck 101 and an orbiting pad assembly 107, any given point on the polishing pad 109 will follow spirographic trajectories, with the entire trajectory lying inside an annulus centered about the center of the wafer. An example of such trajectory is shown in FIG. 4. The wafer 103 rotates about its center axis 105 while the polish pad 109 orbits. Shown in FIG. 4 is an annulus with an outer limit 250, an inner limit 260, and an example trajectory 270. In the example shown, the platen orbit speed is 16 times the wafer chuck 101 rotation speed, but such a ratio is not critical to the operation of the EPD system described here.

In a preferred embodiment of the present invention, the location of the orbital motion of through-hole 112 is contained entirely within the area circumscribed by the perimeter of the wafer 103. In other words, the outer limit 250 is equal to or less than the radius of wafer 103. As a result, the wafer 103 is illuminated continuously, and reflectance data can be sampled continuously. In this embodiment, an endpoint signal is generated at least once per second, with a preferred integration time of light sensor 119 (FIG. 1) being 15 ms. When properly synchronized, any particular point within the sample annulus can be detected repeatedly. Furthermore, by sampling twice during the orbit cycle of the pad, at the farthest point in the orbit from the wafer center and the nearest point, the reflectance at the inner and outer radii can be detected. Thus, with a single sensor one can measure uniformity at two radial points. For stable production processes, measuring uniformity at two radial points can be sufficient for assuring that a deviation from a stable process is detected when the deviation occurs.

Orbital position sensor 143 provides the orbital position of the pad assembly while the wafer chuck's rotary position sensor 142 provides the angular position of the wafer chuck to the computer 121, respectively. The computer 121 can then synchronize the trigger of the data collection to the positional information from these sensors. The orbital sensor identifies which radius the data are coming from and the combination of the orbital sensor and the rotary sensor determine which point. Using this synchronization method, any particular point within the sample annulus can be detected repeatedly.

With additional sensors in the pad backer 120 and polishing pad 109, each sampled with proper synchronous triggering, any desired measurement pattern can be obtained, such as radial scans, diameter scans, multipoint polar maps, 52-site Cartesian maps, or any other calculable pattern. These patterns can be used to assess the quality of the polishing process. For example, one of the standard CMP measurements of quality is the standard deviation of the thicknesses of the material removed, divided by the mean of thicknesses of the material removed, measured over the number of sample sites. If the sampling within any of the annuli is done randomly or asynchronously, the entire annulus can be sampled, thus allowing measurements around the wafer. Although in this embodiment the capability of sensing the entire wafer is achieved by adding more sensors, alternate approaches can be used to obtain the same result.

For example, enlarging the orbit of the pad assembly increases the area a single sensor can cover. If the orbit diameter is one-half of the wafer radius, the entire wafer will be scanned, provided that the inner limit of the annulus coincides with the wafer center. In addition, the fiber optic end may be translated within a canal 104 to stop at multiple positions by means of another moving assembly. In light of this disclosure, one of ordinary skill in the art can implement alternative approaches that achieve the same result without undue experimentation.

Simply collecting the reflected spectral data 218 is generally insufficient to allow the EPD system to be robust, since the amplitude of the signal fluctuates considerably, even when polishing uniform films. The present invention further provides methods for analyzing the spectral data to process EPD information to more accurately detect the endpoint.

The amplitude of the reflected spectral data 218 collected during CMP can vary by as much as an order of magnitude, thus adding "noise" to the signal and complicating analysis. The amplitude "noise" can vary due to: the amount of slurry between the wafer and the end of the fiber optic cable; the variation in distance between the end of the fiber optic cable and the wafer (e.g., this distance variation can be caused by pad wear or vibration); changes in the composition of the slurry as it is consumed in the process; changes in surface roughness of the wafer as it undergoes polishing; and other physical and/or electronic sources of noise.

Figure 5A:
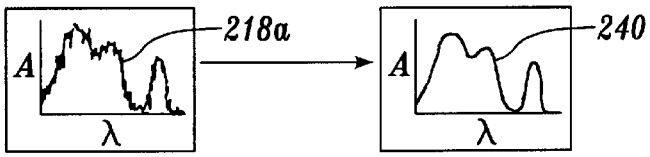
FIGS. 5A–5F are diagrams illustrating the effects of applying various noise-reducing methodologies to the reflected spectral data, in accordance with the present invention.

Several signal processing techniques can be used for reducing the noise in the reflected spectral data 218*a*–218*f*, as shown in FIGS. 5A–5F. For example, a technique of single-spectrum wavelength averaging can be used as illustrated in FIG. 5A. In this technique, the amplitudes of a given number of pixels within the single spectrum and centered about a central pixel are combined mathematically to produce a wavelength-smoothed data spectrum 240. For example, the data may be combined by simple average, boxcar average, median filter, gaussian filter, or other standard mathematical means when calculated pixel by pixel over the reflected spectral data 218*a*. The smoothed spectrum 240 is shown in FIG. 5A as a plot of amplitude vs. wavelength.

Figure 5B:
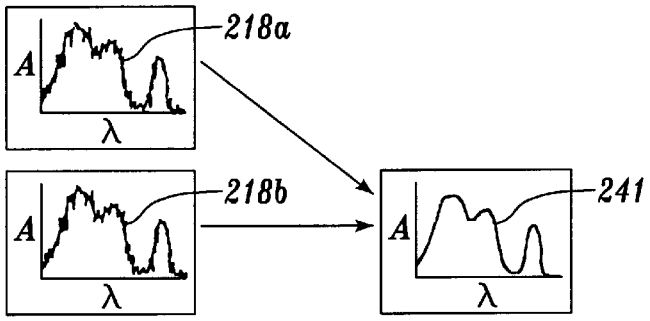

Alternatively, a time-averaging technique may be used on the spectral data from two or more scans (such as the reflected spectral data 218*a* and 218*b* representing data taken at two different times) as illustrated in FIG. 5B. In this technique, the spectral data of the scans are combined by averaging the corresponding pixels from each spectrum, resulting in a smoother spectrum 241.

Figure 5C:
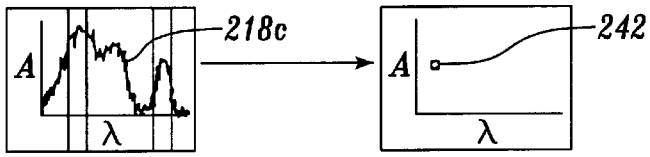

In another technique illustrated in FIG. 5C, the amplitude ratio of wavelength bands of reflected spectral data 218*c* are calculated using at least two separate bands consisting of one or more pixels. In particular, the average amplitude in each band is computed and then the ratio of the two bands is calculated. The bands are identified for reflected spectral data 218*g* in FIG. 5C as 520 and 530, respectively. This technique tends to automatically reduce amplitude variation effects since the amplitude of each band is generally affected in the same way while the ratio of the amplitudes in the bands removes the variation. This amplitude ratio results in the single data point 242 on the ratio vs. time plot of FIG. 5C.

Figure 5D:
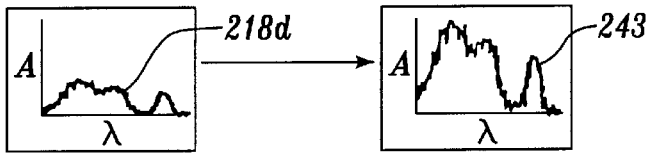
Figure 5E:
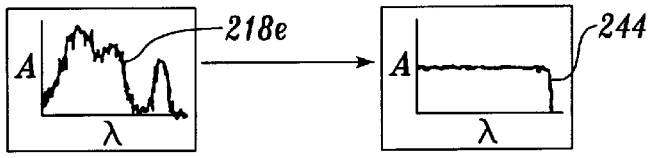

FIG. 5D illustrates a technique that can be used for amplitude compensation while polishing metal layers on a semiconductor wafer. For metal layers formed from tungsten (W), aluminum (Al), copper (Cu), or other metal, it is known that, after a short delay of 10 to 25 seconds after the initial startup of the CMP metal process, the reflected spectral data 218*d* are substantially constant. Any changes in the reflected spectral data 218*d* amplitude would be due to noise as described above. After the short delay, to compensate for amplitude variation noise, several sequential scans (e.g., 5 to 10 in a preferred embodiment) are averaged to produce a reference spectral data signal, in an identical way that spectrum 241 was generated. Furthermore, the amplitude of each pixel is summed for the reference spectral signal to determine a reference amplitude for the entire 512 pixels present. Each subsequent reflected spectral data scan is then "normalized" by (i) summing up all of the pixels for the entire 512 pixels present to obtain the sample amplitude, and then (ii) multiplying each pixel of the reflected spectral data by the ratio of the reference amplitude to the sample amplitude to calculate the amplitude-compensated spectra 243.

Figure 5F:
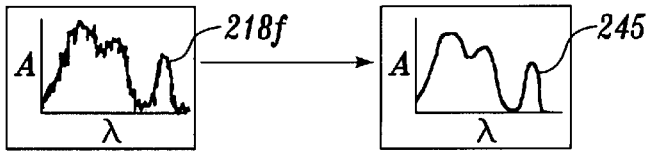

In addition to the amplitude variation, the reflected spectral data, in general, also contain the instrument function response. For example, the spectral illumination of the light source 117 (FIG. 1), the absorption characteristics of the various fiber optics and the coupler, and the inherent interference effects within the fiber optic cables, all undesirably appear in the signal. As illustrated in FIG. 5F, it is possible to remove this instrument function response by normalizing the reflected spectral data 218*f* by dividing the reflected spectral data 218*f* by the refleted signal obtained when a "standard" reflector is placed on the pad 109 (FIG. 1). The "standard" reflector is typically a first surface of a highly reflective plate (e.g., a metallized plate or a partially polished metallized semiconductor wafer). The instrument-normalized spectrum 244 is shown as a relatively flat line with some noise still present.

In view of the present disclosure, one of ordinary skill in the art may employ other means, to process reflected spectral data 218*f* to obtain the smooth data result shown as spectra 245. For example, the aforementioned techniques of amplitude compensation, instrument function normalization, spectral wavelength averaging, time averaging, amplitude ratio determination, or other noise reduction techniques known to one of ordinary skill in the art, can be used individually or in combination to produce a smooth signal.

It is possible to use the amplitude ratio of wavelength bands to generate an endpoint signal 124 directly. Further processing on a spectra-by-spectra basis may be required in some cases. For example, this further processing may include determining the standard deviation of the amplitude ratio of the wavelength bands, further time averaging of the amplitude ratio to smooth out noise, or other noise-reducing signal processing techniques that are known to one of ordinary skill in the art.

Figure 5G:
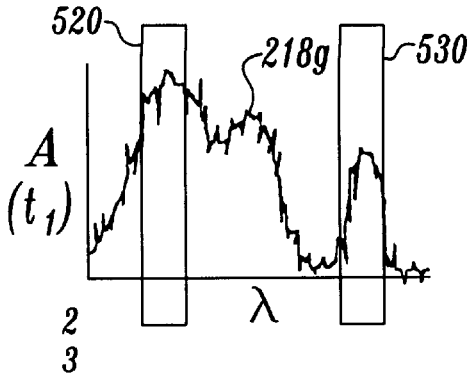
FIGS. 5G–5K are diagrams illustrating the formation of one endpoint signal (EPS) from the spectral data of the reflected light signal and show transition points in the polishing process, in accordance with one embodiment of the present invention.
Figure 5H:
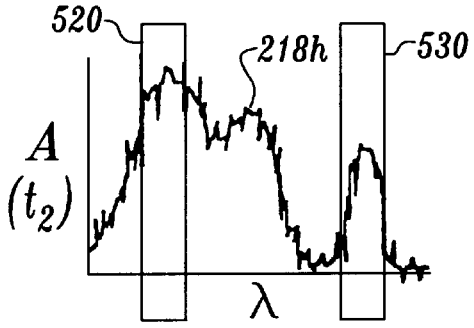
Figure 5I:
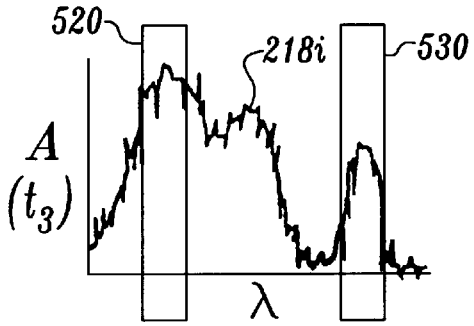
Figure 5J:
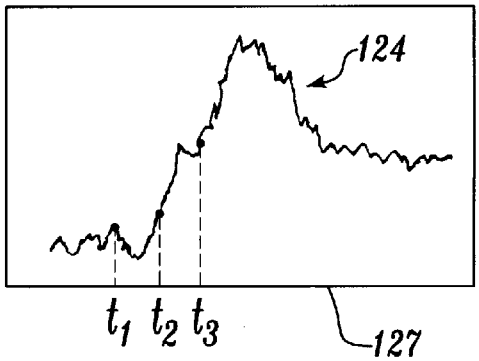
Figure 5K:
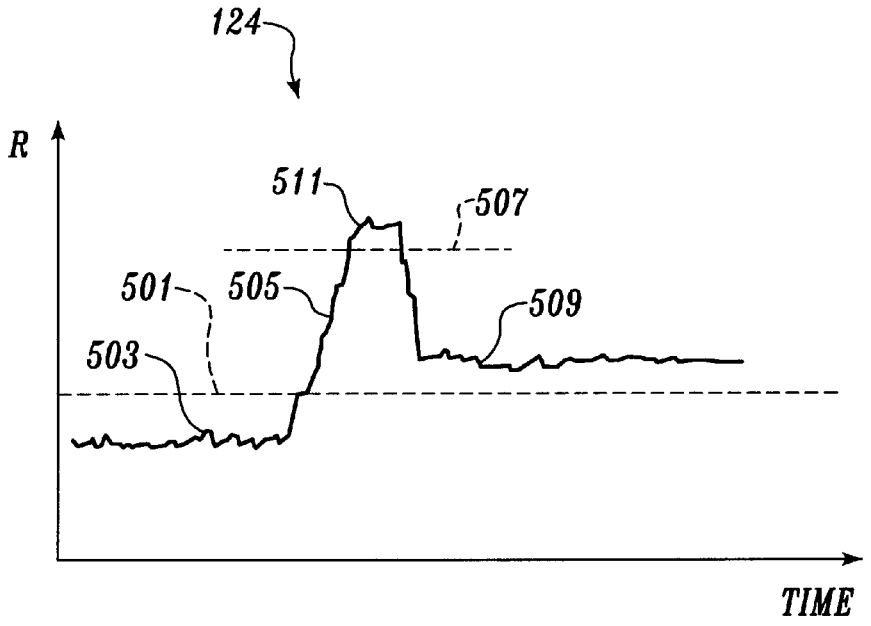

FIGS. 5G–5J illustrate the endpoint signal 124 generated by applying the amplitude ratio of wavelength bands technique described in conjunction with FIG. 5C to the sequential reflected spectral data 218*g*, 218*h*, and 218*i* during the polishing of a metallized semiconductor wafer having metal over a barrier layer and a dielectric layer. The wavelength bands 520 and 530 were selected by looking for particularly strong reflectance values in the spectral range. This averaging process provides additional noise reduction. Moreover, it was found that the amplitude ratio of wavelength bands changed as the material exposed to the slurry and polish pad changed. Plotting the ratio of reflectance at these specific wavelengths versus time shows distinct regions that correspond to the various layer being polished. Of course, the points corresponding to FIGS. 5G–5I are only three points of the plot, as illustrated in FIG. 5J. In practice, as illustrated in FIG. 5K, the transition above a threshold value 501 indicates the transition from a bulk metal layer 503 to the barrier layer 505, and the subsequent lowering of the level below threshold 507 after the peak 511 indicates the transition to the dielectric layer 509. Wavelength bands 520 and 530 are selected from the bands 450 to 475 nm, 525 to 550 nm, or 625 to 650 nm in preferred embodiments for polishing tungsten (W), titanium nitride (TiN), or titanium (Ti) films formed on silicon dioxide ($SiO_2$). As described previously, these wavelength bands can be different for different materials and different CMP processes, and typically would be determined empirically.

In the present invention, integration times may be increased to cover larger areas of the wafer with each scan. In addition, any portion of the wafer within the annulus of a sensor trajectory can be sensed, and with a plurality of sensors or other techniques previously discussed, the entire wafer can be measured.

Figure 6:
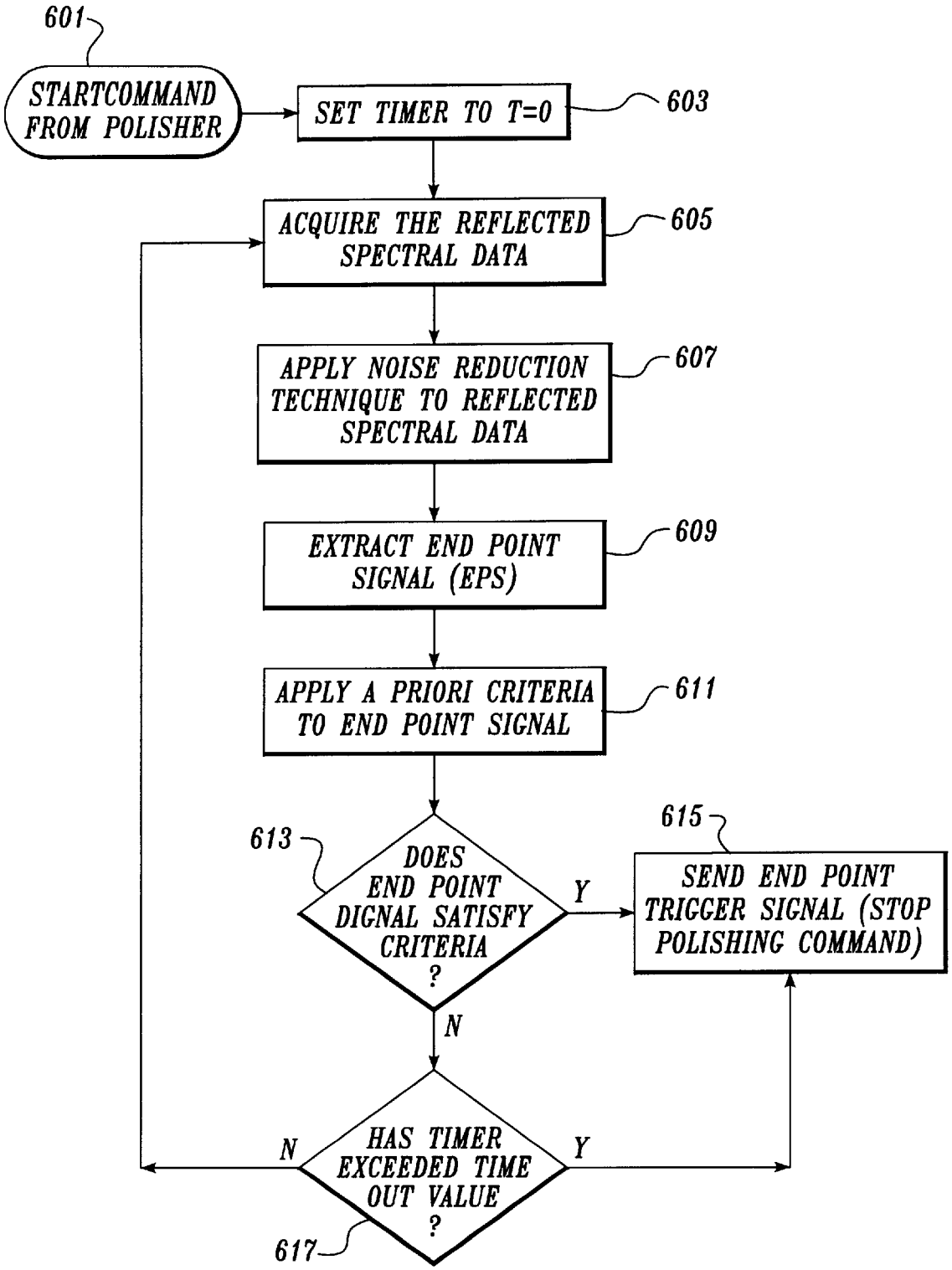
FIG. 6 is a flow diagram illustrating the analysis of the reflectance signal in accordance with the present invention.

For a metal polish process, the specific method of determining the plot of FIG. 5 is illustrated in the flow diagram of FIG. 6. The process of FIG. 6 is implemented by computer 121 properly programmed to carry out the process of FIG. 6. First, at a box 601, a start command is received from the CMP apparatus. After the start command has been received, at box 603, a timer is set to zero. The timer is used to measure the amount of time required from the start of the CMP process until the endpoint of the CMP process has been detected. This timer is advantageously used to provide a fail-safe endpoint method. If a proper endpoint signal is not detected by a certain time, the endpoint system issues a stop polishing command based solely on total polish time. In effect, if the timeout is set properly, no wafer will be overpolished and thereby damaged. However, some wafers may be underpolished and have to undergo a touchup polish if the endpoint system fails, but these wafers will not be damaged. The timer can also be advantageously used to determine total polish time so that statistical process control data may be accumulated and subsequently analyzed.

Next, at box 605, the computer 121 acquires the reflected spectral data 218 provided by the light sensor 119. This acquisition of the reflected spectral data 218 can be accomplished as fast as the computer 121 will allow, be synchronized to the timer for a preferred acquisition time of every 1 second, be synchronized to the rotary position sensor 142, and/or be synchronized to the orbital position sensor 143. The reflected spectral data 218 consist of a reflectance value for each of the plurality of pixel elements 205 of the detector array 203. Thus, the form of the reflected spectral data 218 will be a vector $R_{wbi}$ where i ranges from one to $N_{PE}$, where $N_{PE}$ represents the number of pixel elements 205. The preferred sampling time is to acquire a reflected spectral data 218 scan every 1 second. The preferred integration time is 15 milliseconds.

Next at box 607, the desired noise reduction technique or combination of techniques is applied to the reflected spectral data 218 to produce a reduced noise signal. At box 607, the desired noise reduction technique for metal polishing is to calculate the amplitude ratio of wavelength bands. The reflectance of a first preselected wavelength band 520 ($R_{wbx}$) is measured and the amplitude stored in memory. Similarly, the reflectance of the second preselected wavelength band 530 ($R_{wby}$) is measured and its amplitude stored in memory. The amplitude of the first preselected wavelength band ($R_{wb1}$) is divided by the amplitude of the second preselected wavelength band ($R_{wb2}$) to form a single value ratio that is one data entry vs. time and forms part of the endpoint signal (EPS) 124.

Next at box 609, the endpoint signal 124 is extracted from the noise-reduced signal produced in box 607. For metal polishing, the noise-reduced signal is also already the endpoint signal 124. For dielectric processing, the preferred endpoint signal is derived from fitting the reduced-noise signal from box 607 to a set of optical equations to determine the film stack thickness remaining, as one of ordinary skill in the art can accomplish. Such techniques are well known in the art. For example, see MacLeod, THIN FILM OPTICAL FILTERS (out of print), and Born et al., PRINCIPLES OF OPTICS: ELECTRONIC THEORY OF PROPAGATION, INTERFERENCE AND DIFFRACTION OF LIGHT, Cambridge University Press, 1998.

Next, at box 611, the endpoint signal 124 is examined using predetermined criteria to determine if the endpoint has been reached. The predetermined criteria are generally determined from empirical or experimental methods.

For metal polishing, a preferred endpoint signal 124 over time in exemplary form is shown in FIG. 5 by reference numeral 124. As seen, as the CMP process progresses, the EPS varies and shows distinct variation. The signal is first tested against threshold level 501. When it exceeds level 501 before the timer has timed out, the computer then compares the endpoint signal to level 507. If the endpoint signal is below 507 before the timer has timed out, then the transition to oxide has been detected. The computer then adds on a predetermined fixed amount of time and subsequently issues a stop polish command. If the timer times out before any of the threshold signals, then a stop polish command is issued. The threshold values are determined by polishing several wafers and determining at what values the transitions take place.

For dielectric polishing, a preferred endpoint signal results in a plot of remaining thickness vs. time. The signal is first tested against a minimum remaining thickness threshold level. If the signal is equal to or lower than the minimum thickness threshold before the timer has timed out, the computer then adds on a predetermined fixed amount of time and subsequently issues a stop polish command. If the timer times out before the threshold signal, then a stop polish command is issued. The threshold value is determined by polishing several wafers, then measuring remaining thickness with industry-standard tools and selecting the minimum thickness threshold.

The specific criteria for any other metal/barrier/dielectric layer wafer system are determined by polishing sufficient numbers of test wafers, generally 2 to 10 and analyzing the reflected signal data 218, finding the best noise reduction technique, and then processing the resulting spectra on a spectra-by-spectra basis in time to generate a unique endpoint signal that may be analyzed by simple threshold analysis. In many cases, the simplest approach works best. In the case of dielectric polishing or shallow trench isolation dielectric polishing, a more complicated approach will generally be warranted.

Next, at box 613, a determination is made as to whether or not the EPS satisfies the predetermined endpoint criteria. If so, then at box 615, the endpoint trigger signal 125 is transmitted to the CMP apparatus and the CMP process is stopped. If the EPS does not satisfy the predetermined endpoint criteria, the process goes to box 617 where the timer is tested to determine if a timeout has occurred. If no timeout has occurred, the process returns to box 605 where another reflected data spectrum is acquired. If the timer has timed out, the endpoint trigger signal 125 is transmitted to the CMP apparatus and the CMP process is stopped.

Additionally, it is desired that a CMP process should provide the same quality of polishing results across the entire wafer, a measure of the removal rate, and the same removal rate from wafer to wafer. In other words, the polish rate at the center of the wafer should be the same as at the edge of the wafer, and the results for a first wafer should be the same as the results for a second wafer. The present invention may be advantageously used to measure the quality and removal rate within a wafer, and the removal rate from wafer to wafer for the CMP process. For the data provided by an apparatus according to the present invention, the quality of the CMP process is defined as the standard deviation of the time to endpoint for all of the sample points divided by the mean of the set of sample points. In mathematical terms, the quality measure (designated by Q) is:

$$Q = \frac{\sigma}{\bar{x}} \tag{1}$$

The calculation of Q may be accomplished by suitably programmed computer 121. The parameter of quality Q, although not useful for terminating the CMP process, is useful for determining whether or not the CMP process is effective.

The removal rate (RR) of the CMP process is defined as the known starting thickness of the film divided by the time to endpoint. The wafer-to-wafer removal rate is the standard deviation of the RR divided by the average RR from the set of wafers polished.

The embodiments of the optical EPD system described above are illustrative of the principles of the present invention and are not intended to limit the invention to the particular embodiments described. For example, in light of the present disclosure, those skilled in the art can devise without undue experimentation embodiments using different light sources or spectrometers other than those described. Other embodiments of the present invention can be adapted for use in grinding and lapping systems other than the described semiconductor wafer CMP polishing applications. Accordingly, while the preferred embodiment of the invention has been illustrated and described, it will be appreciated that various changes can be made therein without departing from the spirit and scope of the invention.

The embodiments of the invention in which an exclusive property or privilege is claimed are defined as follows:

1. An apparatus for use in a chemical mechanical polishing system to generate an endpoint signal in the polishing of films on a semiconductor wafer surface, the chemical mechanical polishing system being configured to cause a relative motion between a polishing pad and the wafer surface during a polishing process, the apparatus comprising:

a light source configured to generate light of a predetermined bandwidth;

a fiber optic cable assembly having a first end and a second end, wherein the fiber optic cable is configured to propagate light from the light source to the wafer surface through a through-hole in the polishing pad, the first end of the fiber optic cable assembly extending partially into a through-hole in the polishing pad;

a light sensor coupled to the second end of the fiber optic cable assembly, wherein the light sensor is configured to receive light reflected from the wafer surface through the fiber optic cable assembly and generate data corresponding to a spectrum of the reflected light; and a computer coupled to the light sensor, wherein the computer is configured to generate the endpoint signal as a function of the data from the light sensor.

2. The apparatus of claim 1, wherein the computer is further configured to:

generate a stop polishing command by comparing the endpoint signal to at least one criterion; and communicate the stop polishing command to the chemical mechanical polishing system.

3. The apparatus of claim 2, wherein:

the criterion is a threshold value of the amplitude ratio; and the computer is further configured to: (i) generate the endpoint signal as a function of an amplitude ratio of at least two separate wavelength bands; and (ii) generate the stop polishing command when the endpoint signal exceeds the threshold value.

4. The apparatus of claim 1, wherein the computer generates the endpoint signal as a function of data from the light sensor generated synchronously with the relative motions between the polishing pad and the wafer surface such that the endpoint signal can be generated for a selected spot on the wafer surface.

5. The apparatus of claim 1 wherein the through-hole corresponds to a slurry delivery opening.

6. The apparatus of claim 1 wherein the fiber optic cable assembly includes a first fiber optic cable to propagate light to the wafer surface and a second fiber optic cable to propagate reflected light from the wafer surface.

7. The apparatus of claim 1 wherein the fiber optic cable assembly includes a single fiber optic cable to propagate light to the wafer surface and reflected light from the wafer surface.

8. The apparatus of claim 1, wherein the light source outputs light in a continuous spectrum in the bandwidth range of 200 to 1000 nanometers.

9. The apparatus of claim 1, wherein the computer is further configured to generate the endpoint signal as a function of an amplitude ratio of at least two separate wavelength bands.

10. The apparatus of claim 1 wherein the computer is configurable to generate the endpoint signal while the chemical mechanical polishing system is polishing the wafer.

11. A chemical mechanical polishing system for polishing films on a semiconductor wafer surface, the system comprising:

a light source configured to generate light of a bandwidth;

a polishing pad having a through-hole;

a pad backer configured to hold the polishing pad;

a rotatable wafer chuck configured to hold the semiconductor wafer against the polishing pad during a polishing process;

a fiber optic cable assembly having a first end and a second end, the first end of the fiber optic cable assembly being disposed partially into the through-hole, wherein the fiber optic cable assembly is configured to propagate light from the light source to illuminate at least a portion of the wafer surface;

a light sensor coupled to the second end of the fiber optic cable assembly, wherein the light sensor is configured to receive light reflected from the wafer surface through the fiber optic cable assembly, the light sensor being further configured to generate data corresponding to a spectrum of the reflected light; and a computer coupled to the light sensor, wherein the computer is configured to generate an endpoint signal as a function of the data from the light sensor.

12. The system of claim 11, wherein the computer is further configured to terminate the polishing process when the endpoint signal meets at least one criterion.

13. The system of claim 12, wherein:

the criterion is a threshold value of the amplitude ratio; and the computer is further configured to: (i) generate the endpoint signal as a function of an amplitude ratio of at least two separate wavelength bands; and (ii) terminate the polishing process when the endpoint signal exceeds the threshold value.

14. The system of claim 11, wherein the computer generates the endpoint signal as a function of data from the light sensor generated synchronously with the relative motions between the polishing pad and the wafer surface such that the endpoint signal can be generated for a selected spot on the wafer surface.

15. The system of claim 11 wherein the through-hole corresponds to a slurry delivery opening.

16. The system of claim 11 wherein the fiber optic cable assembly includes a first fiber optic cable to propagate light to the wafer surface and a second fiber optic cable to propagate reflected light from the wafer surface.

17. The system of claim 11 wherein the fiber optic cable assembly includes a single fiber optic cable to propagate light to the wafer surface and reflected light from the wafer surface.

18. The system of claim 11, wherein the light source outputs light in a continuous spectrum in the bandwidth range of 200 to 1000 nanometers.

19. The system of claim 11, wherein the computer is further configured to generate the endpoint signal as a function of an amplitude ratio of at least two separate wavelength bands.

20. The system of claim 11 wherein the computer is configurable to generate the endpoint signal while the chemical mechanical polishing system is polishing the wafer.

21. The system of claim 11 wherein the pad backer includes a canal that communicates between a first surface portion of the pad backer and a pinhole opening in a second surface portion of the pad backer, the second surface portion being in contact with the polishing pad when the pad backer holds the polishing pad, and wherein the fiber optic cable assembly is disposed in the canal with the first end extending through the pinhole opening and partially into the through-hole of the polishing pad.

22. A method of detecting an endpoint during chemical mechanical polishing of a wafer surface, the method comprising:

providing a relative rotation between the wafer surface and a pad, the pad contacting the surface during a polishing process of the wafer surface;

illuminating at least a portion of the surface with light having a spectrum while the wafer surface is being polished;

generating reflected spectrum data corresponding to a spectrum of light reflected from the region while the wafer surface is being polished; and determining a value as a function of amplitudes of at least two individual wavelength bands of the reflected spectrum data.

23. The method of claim 22 further comprising arranging a fiber optic cable assembly with one end partially extending into a through-hole in the pad, the fiber optic cable assembly propagating the light and the reflected light through the through-hole.

24. The method of claim 23 wherein the through-hole is a slurry delivery opening.

25. The method of claim 23 wherein the fiber optic cable assembly includes a single fiber optic cable to propagate the light and the reflected light through the hole in the pad.

26. The method of claim 23 wherein the fiber optic cable assembly includes a first fiber optic cable to propagate the light and a second fiber optic cable to propagate the reflected light through the hole in the pad.

27. The method of claim 22 further comprising:

comparing the value to criteria; and terminating the polishing process in response to the value meeting the criteria.

28. The method of claim 22 wherein the spectrum ranges between wavelengths of 200 to 1000 nanometers.

29. An apparatus for detecting an endpoint during polishing of a wafer surface, the apparatus comprising:

means for providing a relative rotation between the wafer surface and a pad, the pad contacting the surface during a polishing process of the wafer surface;

means for illuminating at least a portion of the surface with light having a spectrum while the wafer surface is being polished;

means for generating reflected spectrum data corresponding to a spectrum of light reflected from the region while the wafer surface is being polished; and means for determining a value as a function of amplitudes of at least two individual wavelength bands of the reflected spectrum data.

30. The apparatus of claim 29 further comprising a fiber optic cable assembly arranged with one end partially extending into a through-hole in the pad, the fiber optic cable assembly propagating the light and the reflected light through the through-hole.

31. The apparatus of claim 30 wherein the fiber optic cable assembly includes a single fiber optic cable to propagate the light and the reflected light through the hole in the pad.

32. The apparatus of claim 30 wherein the fiber optic cable assembly includes a first fiber optic cable to propagate the light and a second fiber optic cable to propagate the reflected light through the hole in the pad.

33. The apparatus of claim 30 wherein the through-hole in the pad is a slurry delivery opening.

34. The apparatus of claim 29 further comprising:

means for comparing the value to criteria; and means for terminating the polishing process in response to the value meeting the criteria.

35. The apparatus of claim 29 wherein the spectrum ranges between wavelengths of 200 to 1000 nanometers.

* * * * *